US007770770B2

(12) United States Patent
Murdoch et al.

(10) Patent No.: US 7,770,770 B2
(45) Date of Patent: Aug. 10, 2010

(54) CARRIER SYSTEM

(75) Inventors: Douglas Harland Murdoch, Santa Rosa, CA (US); Michael Sturm, Redding, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 210 days.

(21) Appl. No.: 11/663,202

(22) PCT Filed: Sep. 19, 2005

(86) PCT No.: PCT/US2005/034036

§ 371 (c)(1),
(2), (4) Date: Oct. 16, 2007

(87) PCT Pub. No.: WO2006/034421

PCT Pub. Date: Mar. 30, 2006

(65) Prior Publication Data

US 2009/0039120 A1 Feb. 12, 2009

Related U.S. Application Data

(60) Provisional application No. 60/611,655, filed on Sep. 20, 2004.

(51) Int. Cl.
*A45F 5/00* (2006.01)

(52) U.S. Cl. ..... 224/672; 224/675

(58) Field of Classification Search ..... 224/672, 224/675, 660, 667, 223, 930, 271, 272, 269, 224/195, 666, 665; 24/3.7; 2/312, 318, 319
See application file for complete search history.

(56) References Cited

U.S. PATENT DOCUMENTS

| | | | | | |
|---|---|---|---|---|---|
| 3,907,182 | A * | 9/1975 | Bryant | 224/670 |
| 4,676,419 | A * | 6/1987 | Victor | 224/649 |
| 5,464,136 | A * | 11/1995 | Eddy | 224/666 |
| 5,665,057 | A * | 9/1997 | Murphy | 602/19 |
| 5,881,933 | A * | 3/1999 | Rogers | 224/195 |
| 6,273,872 | B1 * | 8/2001 | Friedman | 604/174 |
| 6,279,804 | B1 * | 8/2001 | Gregg | 224/675 |
| 6,412,674 | B1 * | 7/2002 | Lipke | 224/240 |
| 6,691,906 | B2 * | 2/2004 | Cragg | 224/238 |
| 6,729,518 | B2 * | 5/2004 | Badillo et al. | 224/578 |
| 7,110,802 | B1 * | 9/2006 | Kim et al. | 455/575.6 |
| 2004/0226972 | A1 * | 11/2004 | Cook | 224/195 |
| 2008/0296327 | A1 * | 12/2008 | Murdoch et al. | 224/195 |

* cited by examiner

*Primary Examiner*—Justin M Larson
(74) *Attorney, Agent, or Firm*—R. Dabney Eastham

(57) ABSTRACT

A system for carrying articles on a user's belt, comprising a belt (10) having multiple loops (22) on its outside surface and an article carrier (1) having a sleeve (40) sewn to the body of the carrier at a first end (42) and detachably connected to the body of the carrier at a second end (44). A stiff tab (60) is sewn at one end thereof into the sewn connection of the body of the carrier to the sleeve. The other end of the tab (64) is unattached and overlapped by the sleeve when the sleeve is wrapped around the belt for supporting the carrier from the belt. The carrier can be moved along the belt and placed in different positions unless the free end of the tab is inserted through a loop on the belt in which case the carrier will be fixed in position with respect to the belt.

11 Claims, 8 Drawing Sheets

CARRIER SYSTEM

CROSS-REFERENCE TO RELATED APPLICATION

This application claims the benefit of U.S. provisional patent application Ser. No. 60/611,655, filed on Sep. 20, 2004 for a "Carrier System."

FIELD OF THE INVENTION

The field of the invention is that of article carriers supported by an animate bearer, such as a human being.

BACKGROUND OF THE INVENTION

Human beings have long carried articles by attaching them to belts worn around the waist or hips. Such objects have included canteens, weapons, food carriers, and the like. In modern times, for example, photographers may carry cameras, lens systems such as telephoto lens systems, and other photographic gear in pouches or carriers suspended from a belt worn about the waist or hips.

An article to be carried by a belt may be permanently or releaseably attached to a definite position on the belt. Alternatively, the article may be attached to the belt by a sleeve or the like so that the article may be moved along the belt as needed in order to access the article or to wear it in the most comfortable position.

A belt carrier system that provides for both types of attachment at the choice of the wearer is needed.

U.S. Pat. No. 5,881,933 to Rogers, entitled "Track Member System" discloses a system for carrying containers suspended from a track member which may be attached to a body encircling belt or attached to clothing which includes a pair of protruding tracks substantially parallel and from which the containers for holding articles are suspended by clips on the containers which are attachable to the tracks anywhere along the lengths thereof or positionable lengthwise on the tracks by sliding thereon at tapered ends of the tracks. This system includes a clamp in the form of a planar wedge for locking the container in place on the tracks to prevent the container from sliding along the tracks to an undesired position and inhibiting forceful unintended removal of the clip and container from the tracks without removal of the clamp. The track member system of Rogers is complicated and expensive to make because its construction requires the provision of two parallel and protruding members and a rigid clip attached to a carrier that is specifically shaped to receive the parallel members and thereby hold the carrier on the belt. The security of the attachment of the clip to the carrier depends on how well the clip encloses the members so that failure of that enclosure will cause detachment of the carrier from the belt. In addition, the planar wedge clamp is complicated and requires the provision of additional components.

What is needed for is an improved carrier system that provides for attaching articles to a belt that provides for the articles to be releaseably attached at a fixed position on the belt or, in the alternative, to be in a slideable relation to the belt.

SUMMARY OF THE INVENTION

The invention is a system comprising an elongated planar member or belt to be worn by an animate bearer such as a human being having an outside surface facing away from the bearer's body and an inside surface facing toward the body of the bearer, at least one loop or pocket attached to the outside surface of the belt, and at least one carrier for an object comprising a sleeve having a first end attached to a body of the carrier and a second end detachably attached to the body of the carrier, the first end and the second end of the sleeve being spaced apart at their respective places of attachment to the body of the carrier so that the second end of the sleeve can be folded over the belt and attached to the body of the carrier, and further comprising a tab of stiff material having a first end attached to the carrier at or near the junction of the first end of the sleeve to the carrier and a second end remaining unattached, the tab having an axis generally aligned with the sleeve, the second of the tab being capable of being inserted through one of the loops of the belt when the sleeve is folded over the belt for attachment of the carrier to the belt and thereby fixing the carrier with respect to the belt so that the carrier substantially may not be slid along the belt whereas if the tab is not inserted into a loop when the sleeve is folded over the belt the carrier is not substantially fixed with respect to the belt and therefore may be slid along the belt.

OBJECTS OF THE INVENTION

It is an object and advantage of the present invention to provide to provide an improved system for carrying equipment on the wearer.

Another object and advantage is to provide a system for carrying equipment on the wearer that will positively attach the equipment to a member supported by the wearer so that the equipment will not become accidentally detached.

Another object and advantage is to provide a system that will positively attach equipment to the wearer that will permit the equipment to be moved with respect to the member worn by the wearer while the equipment is supported by that member but alternatively, at the option of the wearer, to permit the equipment to be carried in a fixed relationship to the member.

Another object and advantage is to provide a system for carrying equipment on a wearer that is simple and inexpensive to manufacture.

REFERENCE NUMERALS IN THE DRAWINGS

Figure 1:
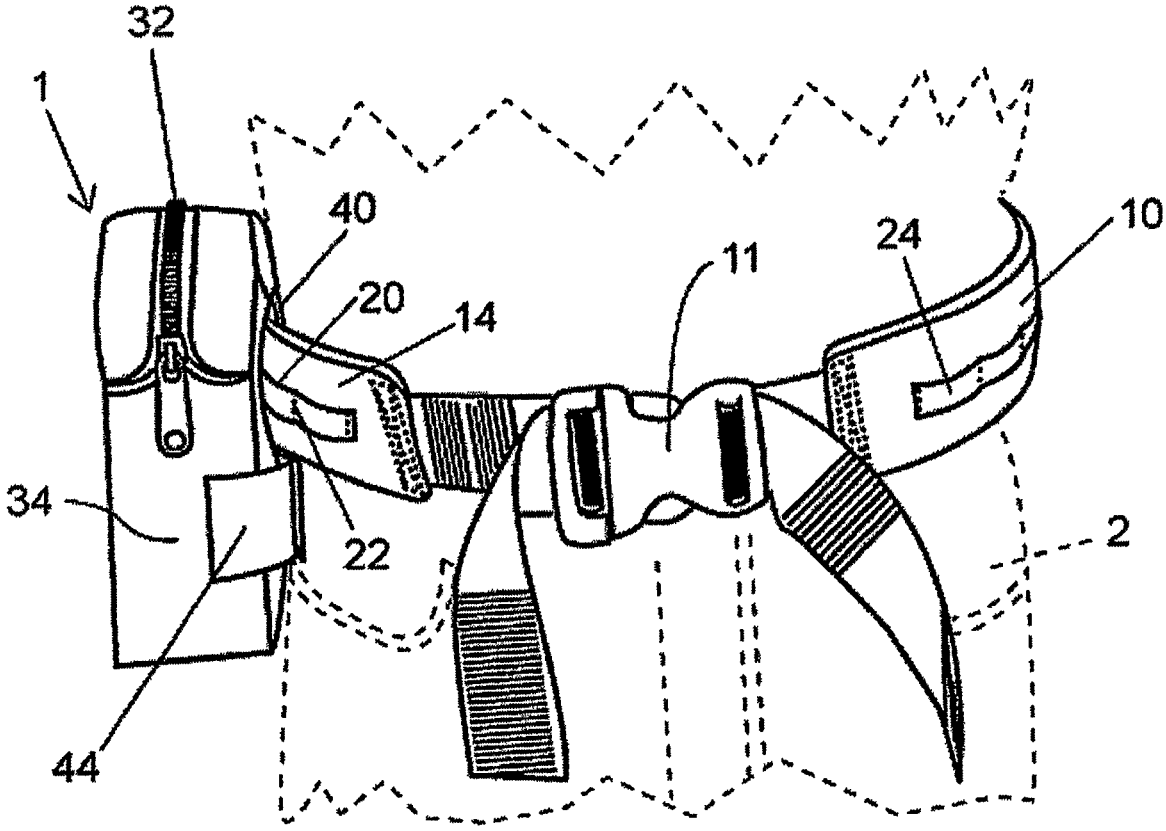
FIG. 1 is a perspective view of a preferred embodiment of the carrier system according to the invention shown being worn by a person.

1 carrier system
2 person
10 belt
11 buckle
12 fabric tube
13 foam interior
14 outside surface of belt
16 inside surface of belt
20 webbing
22 bar tack
24 loop
30 carrier for objects
32 zipper
34 body of carrier
40 sleeve
42 first end of sleeve
44 second end of sleeve
46 loop strip
48 hook strip
60 tab
62 first end of tab
64 second end of tab

DETAILED DESCRIPTION OF THE PREFERRED EMBODIMENTS

Referring now to the drawings, an animate bearer (in this case a person) 2 wearing a preferred embodiment of a carrier system according to the invention 1 is shown in FIG. 1. The carrier system 1 is comprised of a belt 10 attached to a carrier for articles 30.

The belt 10 is shaped in the form of an elongated planar member having an outside surface 14 facing away from the bearer's body and an inside surface 16 (not shown in FIG. 1; see FIG. 3) facing toward the body of the bearer.

Figure 4:
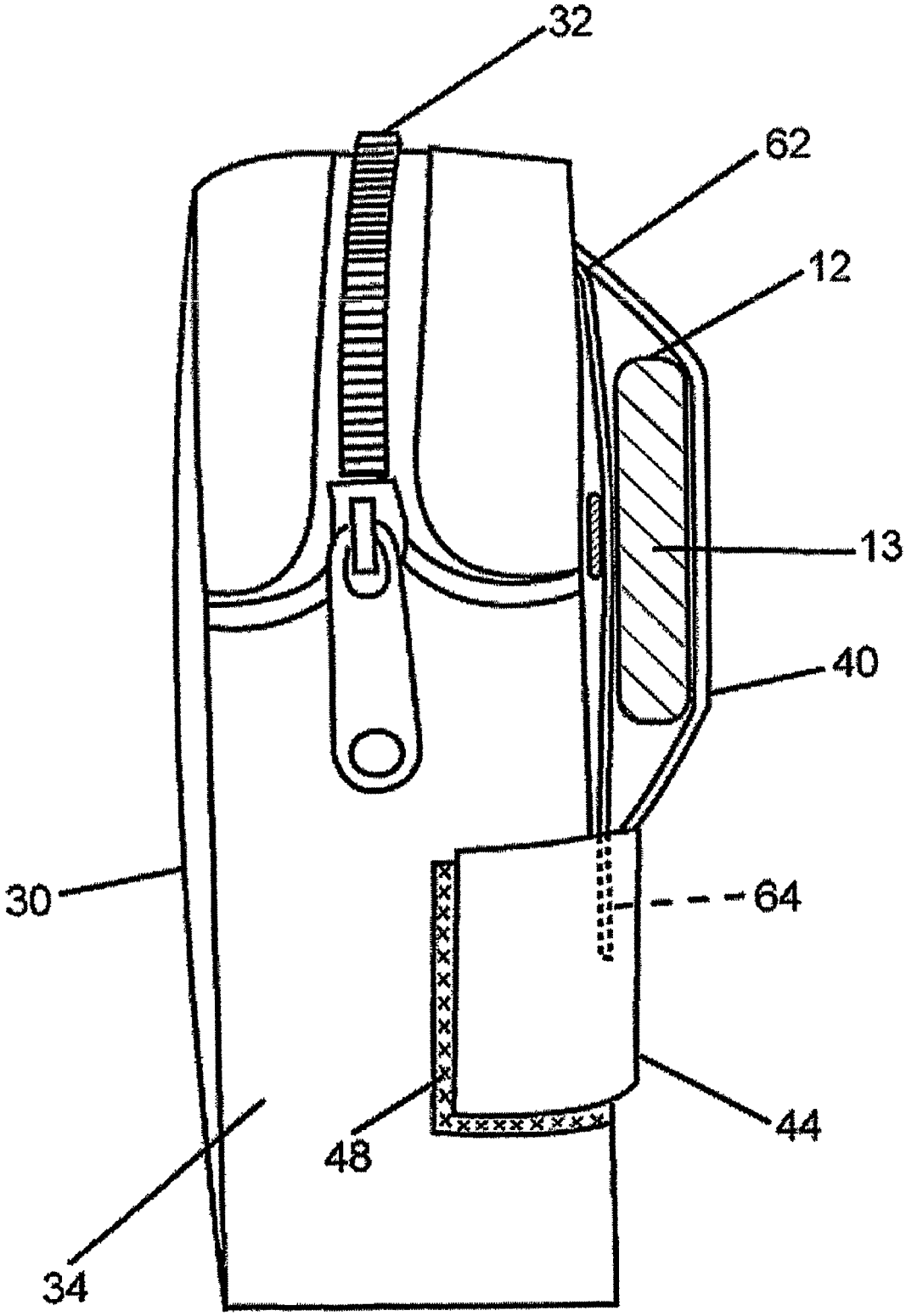
FIG. 4 is a partial sectional view of the portion of the carrier system according to the invention shown in FIG. 2.

The belt 10 is shown in cross-section in FIG. 4 and preferably comprises a fabric tube 12 surrounding a foam interior 13. The foam interior 13 is preferably made of EVA (Ethylene Vinyl Acetate) foam.

The specific structure and materials of the belt 10, however, are not important to this invention. The belt 10 could be made without the foam interior 13 or could be made of leather or other materials known to the art to which this invention pertains.

The belt 10 is secured around the body of the wearer 2 by a buckle 11. The buckle shown in FIG. 1 comprises two mating and detachable pieces formed from a thermoplastic of a kind well known to the art. Such buckles are sold under the FASTEX, DURAFLEX, and other brands. The specific structure and materials of the buckle 11 are not important to this invention. The buckle 11 could have any number of designs and be made of different materials known to the art as long as it is suitable to be a buckle for a belt.

The carrier for articles 30 comprises a body 34 and a sleeve 40. The carrier for articles 30 shown in the drawings is a pouch of a known kind in the photography field having an interior main compartment (not shown) with a top opening secured by a zipper 32. The carrier 30 shown in the drawings is designed to hold photographic articles such as a lens system and the like. The structure and form of the body of the carrier for articles 30 is not important to the invention. All that is necessary is that the carrier for articles 30 be suitable for carrying an article or articles that a wearer may wish to carry. The system of the invention could be used with virtually any carrier for articles, such as a holster for a handgun or a canteen.

Webbing 20 is sewn by regularly spaced bar tacks 22 to the outside surface 14 of the belt 10. The spacing of the bar tacks 22 causes the webbing 20 to form loops (or bottomless pockets) 24 spaced along and above the outside surface 14 of the belt 10. Webbing made of nylon or polyester is preferred.

At least one or more loops 24 must be provided on the outside surface 14 of the belt 10 for cooperation with the tab 60 attached to the carrier for articles 30 (see FIGS. 5 and 7 and the discussion below). The specific structure and materials of the loops 24 are not important as long as at least one loop 24 capable of cooperating with a tab 60 is provided.

The carrier for articles 30 is provided with a sleeve 40 made of fabric. The sleeve 40 has a first end 42 sewn or otherwise attached to the carrier for articles 30, as is best seen in FIGS. 3, 5, 6, and 7. A second end 44 of the sleeve 40 detachably connects to a location on the carrier for articles 30 that is spaced from the attachment of the first end 42 so that the sleeve 40 forms a loop sized to enclose the belt 10 as shown in FIGS. 1-4.

In the preferred embodiment of the invention shown in the drawings the means for attaching the second end 44 of the sleeve 40 to the carrier for articles 30 is by provision of mating hook and loop strips 46 and 48 sewn onto to the carrier for articles 30 and adjacent the second end 44 of the sleeve 40, respectively. Although hook and loop strips are preferred, other means of detachable connection such as snaps and the like are suitable for use in this invention.

Figure 5:
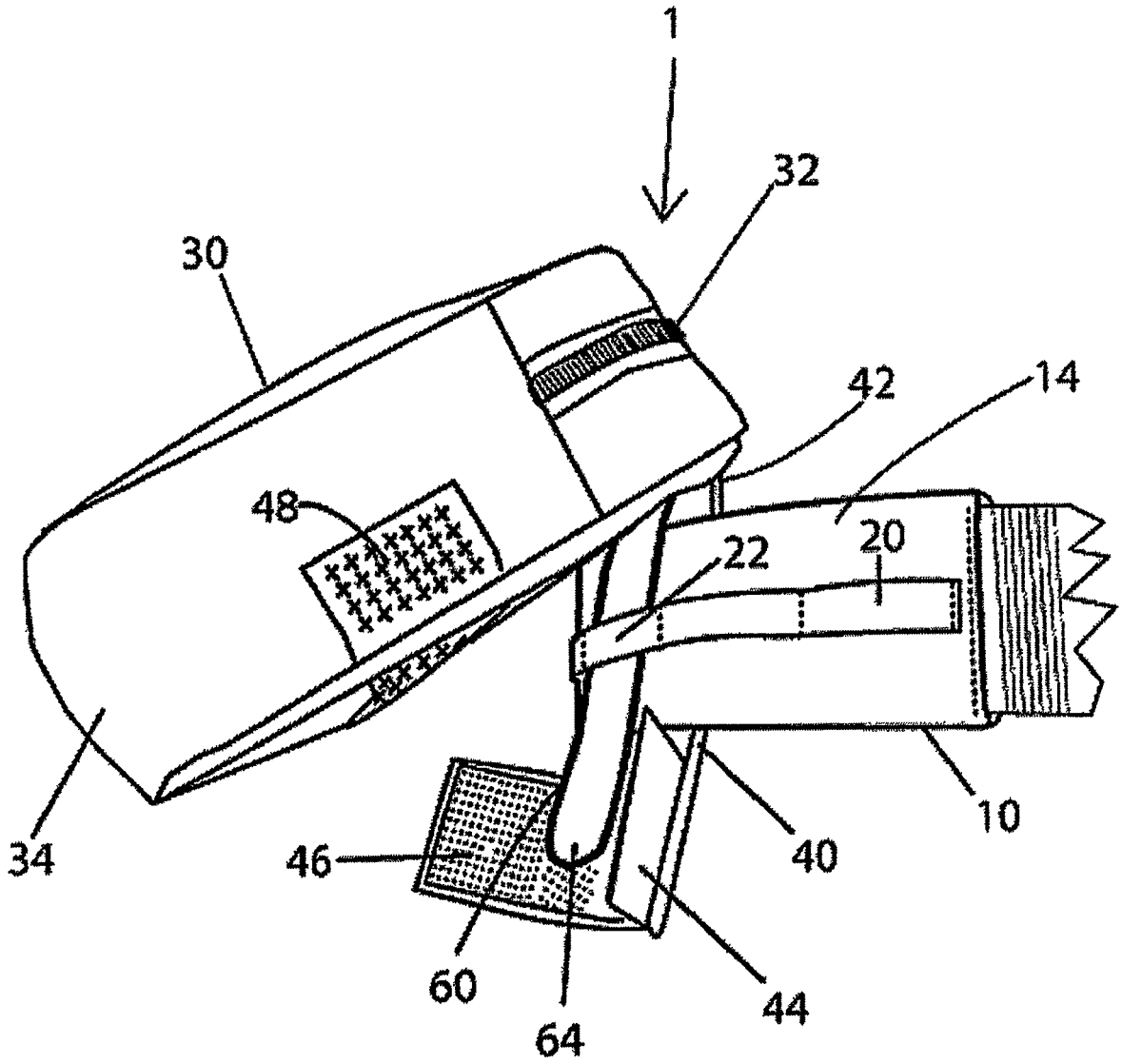
FIG. 5 is a perspective view from the right of the portion of the carrier system according to the invention shown in FIG. 2 demonstrating how the tab attached to a carrier for articles is inserted in a loop attached to the belt so as to prevent the carrier for objects from sliding with respect to the belt.
Figure 6:
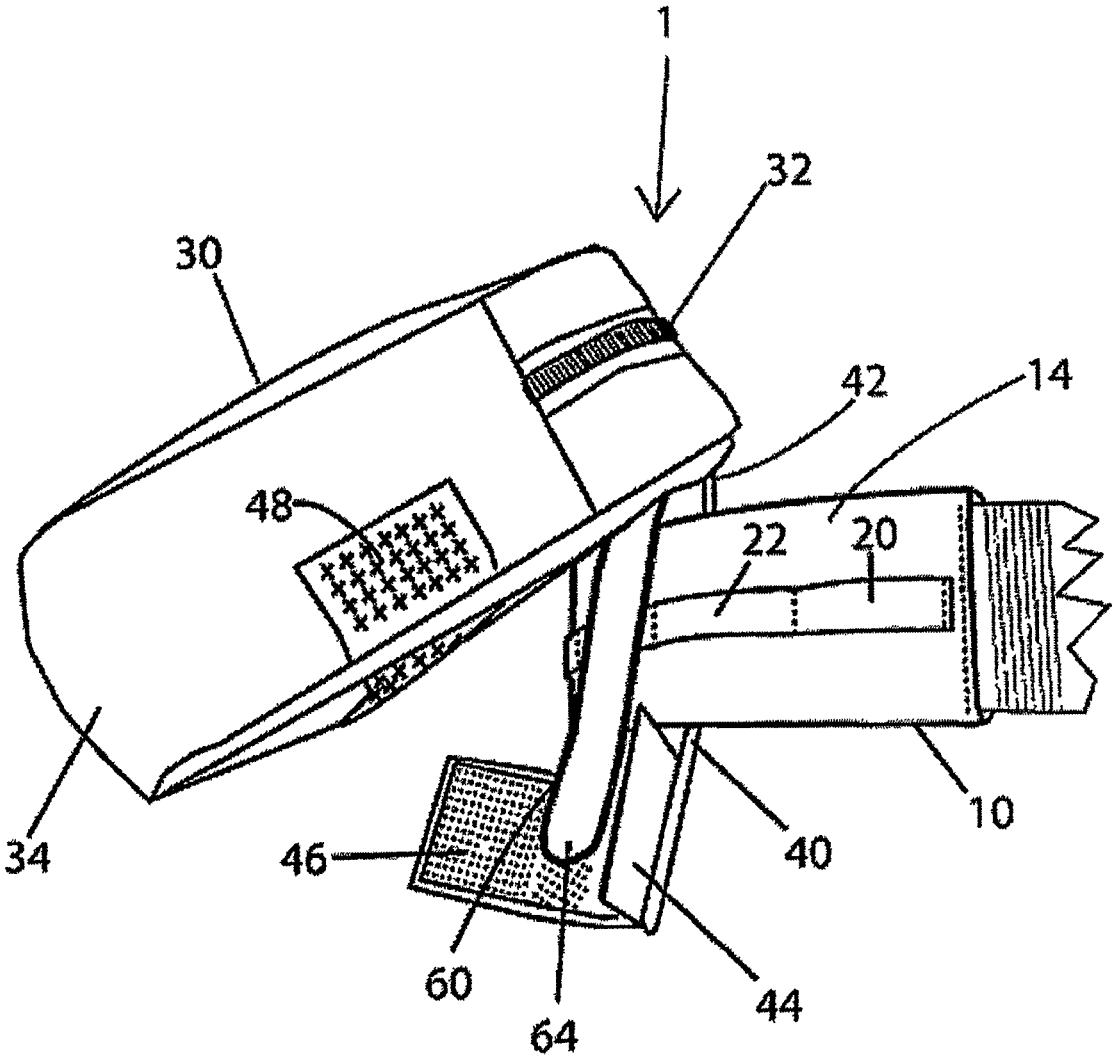
FIG. 6 is a perspective view from the right of a portion of the carrier system according to the invention shown in FIG. 2 demonstrating how the tab of the carrier for objects is not inserted into a loop attached to the belt so as to allow the carrier for articles to slide with respect to the belt.
Figure 7:
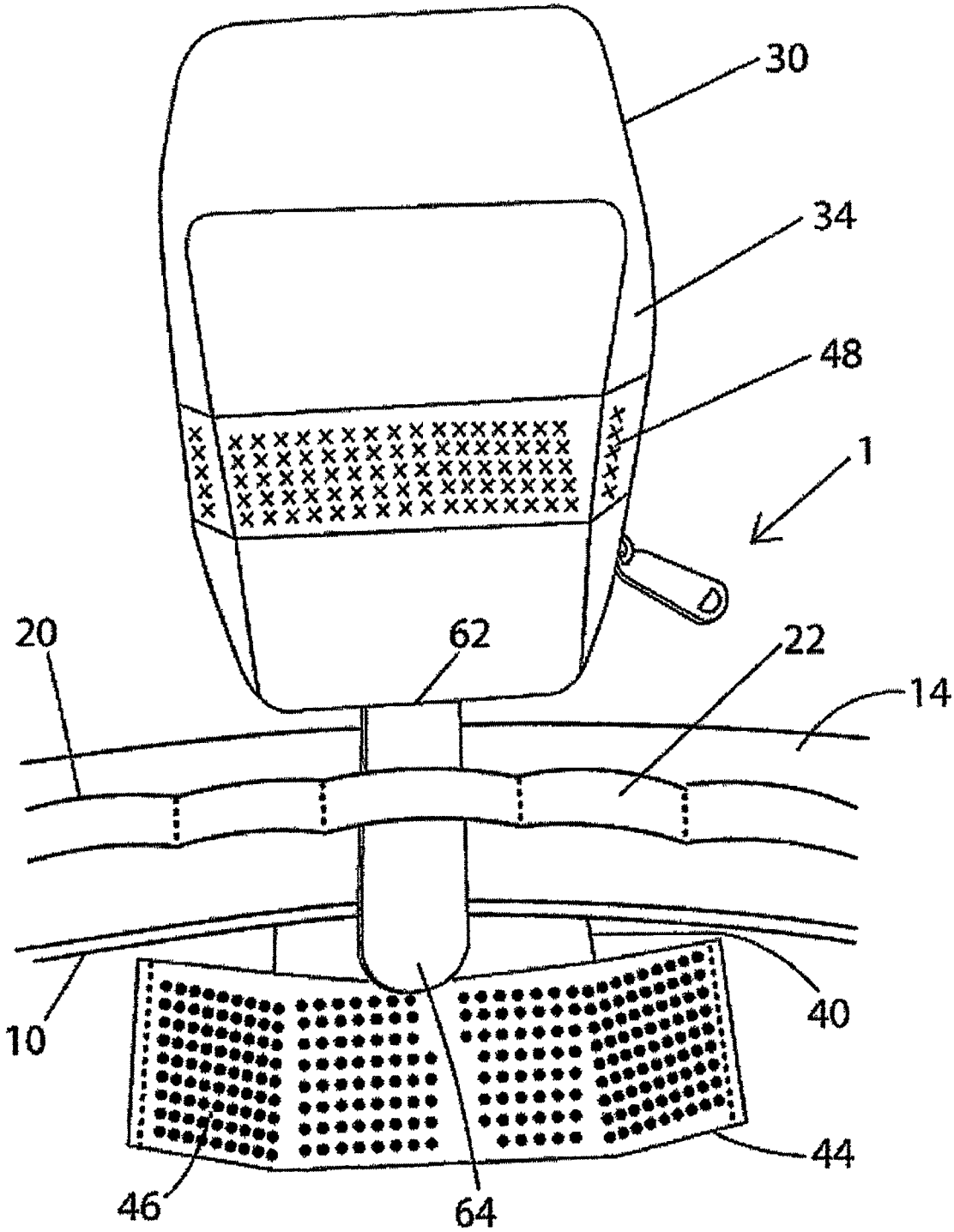
FIG. 7 is a perspective view from below of a portion of the carrier system according to the invention shown in FIG. 2 demonstrating how the tab of the carrier for articles is inserted into a loop attached to the belt so as to prevent the carrier for articles from sliding with respect to the belt.

The means of attachment of the second end 44 of the sleeve 40 to the body 34 of the carrier for articles 30 is illustrated best in FIGS. 4-7. The mating hook and loop strips 46 and 48 may be separated in order to rotate the second end 44 of the sleeve 40 away from the carrier for articles 30 as shown in FIGS. 5-7 so that the carrier for articles 30 can be attached or detached from the belt 10.

The specific structure and materials of the sleeve 40 is not important as long as the sleeve 40 can be detachably secured at one of its ends to the carrier 30.

As may be seen in FIGS. 5-7, a tab 60 is attached to the carrier 30 by being sewn at a first end 62 between the carrier 30 and the first end 42 of the sleeve 40. The tab 60 is preferably made of a thin and stiff material such as polyethylene (PE) board that may be sewn through. The second end 64 of the tab 60 is not sewn or otherwise permanently attached to anything so that it may be inserted through one of the loops 22 as shown in FIGS. 5 and 7.

Figure 2:
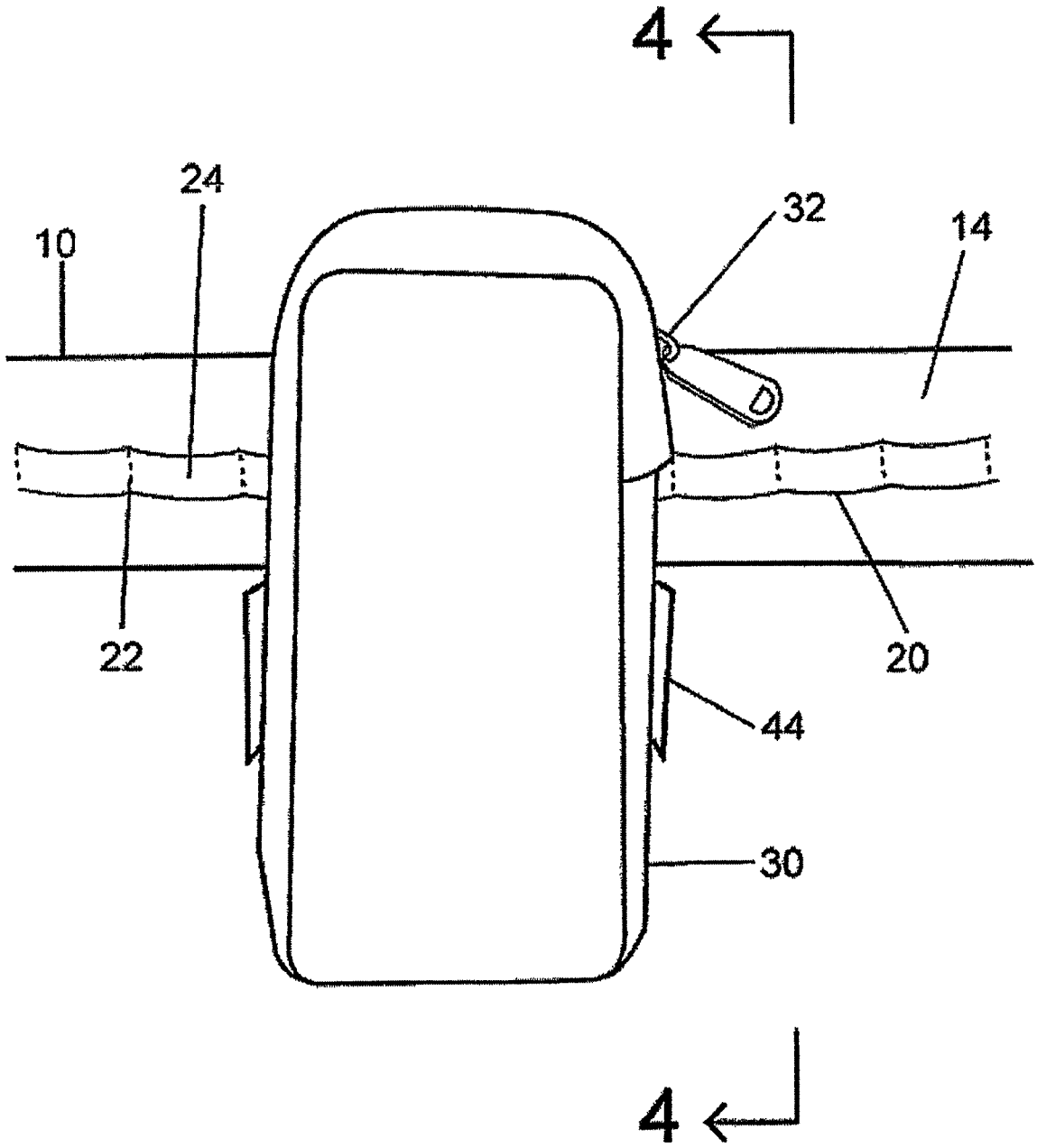
FIG. 2 is a front side view of a portion of the preferred embodiment of the carrier system according to the invention shown in FIG. 1.
Figure 3:
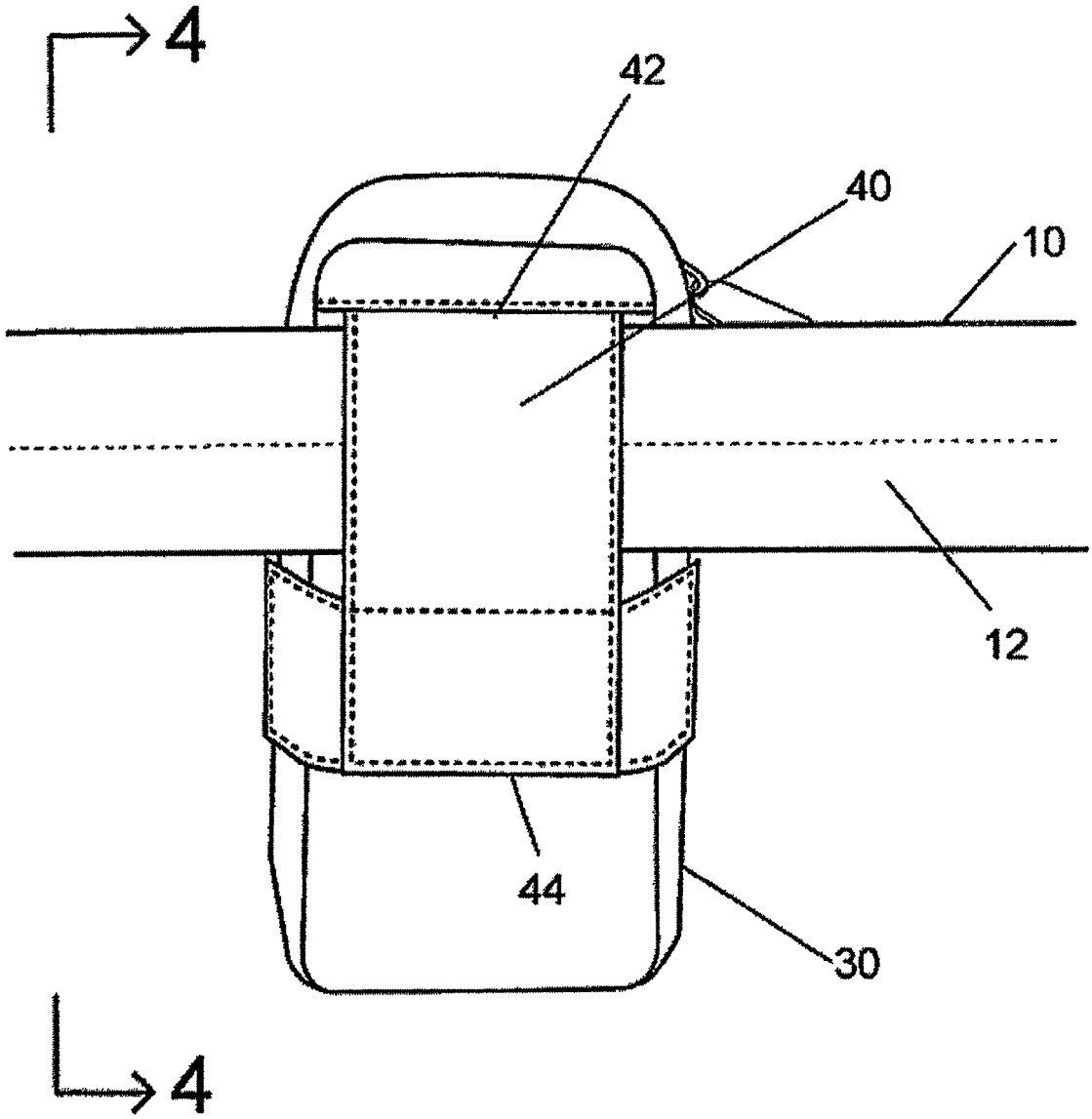
FIG. 3 is a back side view of the portion of the carrier system according to the invention shown in FIG. 2.

The tab 60 lies between the carrier for articles 30 and the sleeve 40 when the second end 44 of the sleeve 40 is attached to the carrier for articles 30 and thus will not be observed when the carrier for articles 30 is in that condition and is viewed from front and back as shown in FIGS. 2 and 3. The tab 60 will be easily observable when the second end 44 of the sleeve 40 is detached from the carrier for articles 30 as shown in FIGS. 5-7.

Figure 8:
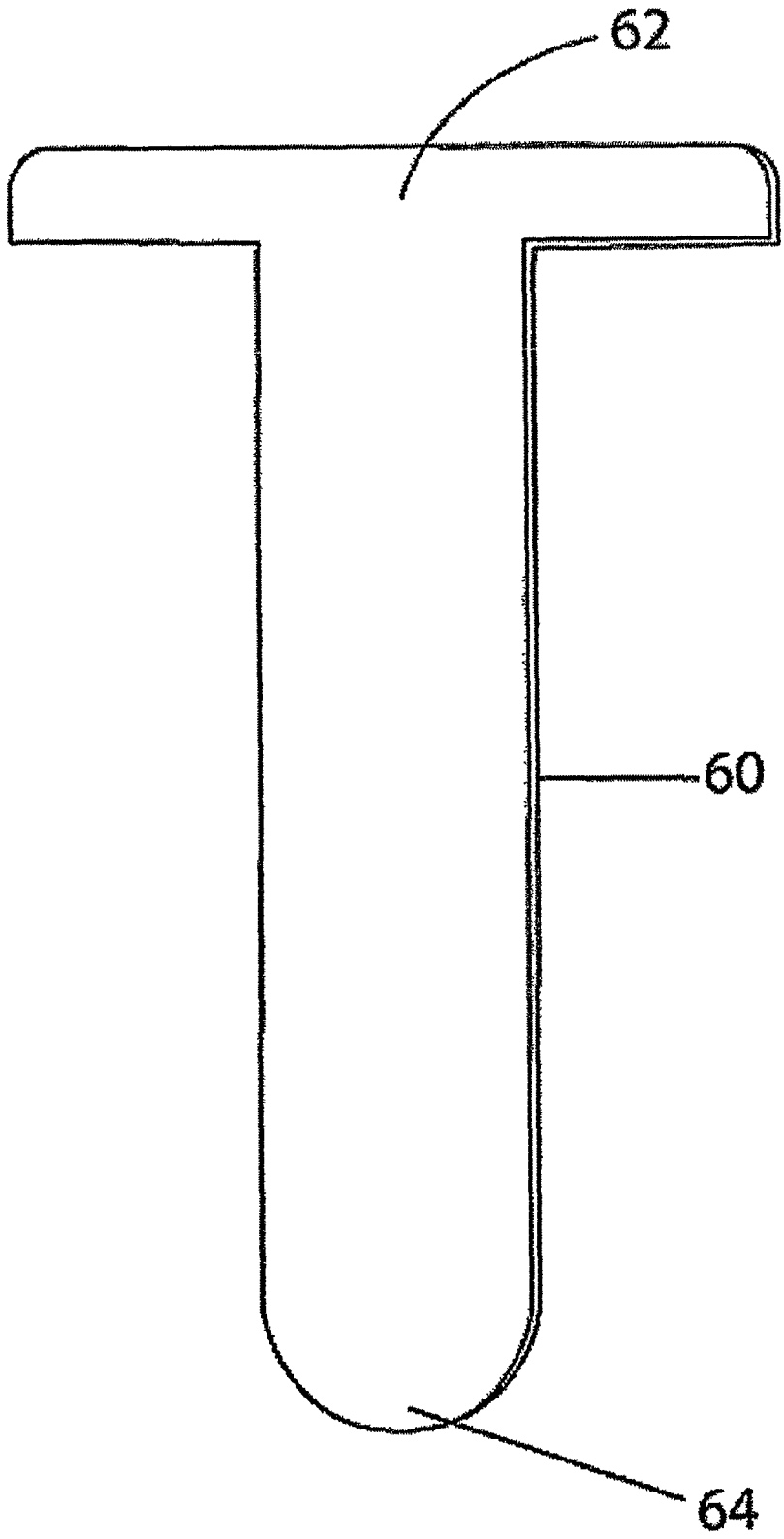
FIG. 8 is a perspective view of the tab shown as a separate component and not attached to the carrier for articles.

The preferred tongue-like structure of the tab 60 is shown in FIG. 8. The first end 62 of the tab 60 is broadened in the form of the cross-bar of a "T" to provide a broader space for sewing in the attachment of that end to the carrier for articles 30. This will help prevent rotation of the second end 64 of the tab 60 from side to side along the plane of the tab and will anchor the tab 60 more securely to the carrier 30 because of the greater length of the stitch line.

The second end 64 of the tab 60 is rounded to facilitate insertion of the second end 64 through one of the loops 22 as shown in FIGS. 5 and 7. The tab 60 being preferably made of a stiff but flexible material such as the PE board mentioned in order facilitates the insertion of the second end 64 through one of the loops 22, Preferably the tab 60 is long enough that the second end 64 will be in contact with the hook and loop strips 46 and 48 when the second end 44 of the sleeve 40 is attached to the body 34 of the carrier for articles 30 but will not extend below or beyond the sleeve 40. This positioning and length of the tab 60 is indicated in FIGS. 5-7. It has been found that the configuration is preferred in order to further prevent twisting or rotation of the tab 60 with respect to its attachment to the body 34 of the carrier for articles 30 when the carrier for articles 30 is subjected to forces that would tend to twist the carrier for articles 30 with respect to the belt 10 because the second or free end 64 of the tab 60 is anchored with respect to the body 34 of the carrier for articles 30 by being trapped between the hook and loop strips 46 and 48.

The carrier for articles 30 may be attached to the belt 10 in one or another of two modes. FIGS. 5 and 7 show a first mode of attachment in which the carrier for articles 30 will be fixed with respect to the belt 10 because the tab 60 is inserted through one of the loops 22 when the sleeve 40 is wrapped around the belt 10. In this mode the carrier for articles 30 cannot slide or move along the belt and therefore will remain in the same position with respect to the body of the bearer as long as the belt 10 itself remains in the same relative position with respect to the body of the bearer. This is the mode to use if the bearer has found a preferred position for the carrier for articles 30 or simply wishes for the carrier for articles 30 to not shift while the bearer is moving.

The other or second mode of attachment is shown in FIG. 6. In this mode the tab 60 is not inserted through one of the loops 22 when the sleeve 40 is wrapped around the belt 10. In this mode the carrier for articles 30 can slide or move along the belt. The bearer can slide or move the carrier for articles 30 on the belt as needed for use and/or comfort. This is the mode to use if the bearer wishes to adjust the position of the carrier for articles 30 without removing the carrier for articles 30 from the belt 10. The bearer, for example, may want to bear the carrier for articles 30 in one position on the belt for reasons of comfort or convenience when moving, sitting or standing but would like to quickly move the carrier for articles 30 to a position for more ready access to the articles contained in the carrier.

While the invention has been described in conjunction with the preferred embodiment, it will be understood that it is not intended to limit the invention to this embodiment. On the contrary, the invention is intended to cover alternatives, modifications and equivalents that may be included within the spirit and scope of the invention as defined by the appended claims.

What is claimed is:

1. A carrier system comprising: an elongated planar member to be worn by an animate bearer such as a human being having an outside surface facing away from the bearer's body and an inside surface facing toward the body of the bearer, at least one loop attached to the outside surface of the member, wherein the loop comprises two ends and a middle section between the two ends, the ends of the loop are spaced apart along the planar member and attached to the outside surface of the planar member and the middle section is not attached to the outside surface of the planar member, whereby the tab may be received between the loop and the outside surface of the planar member when the sleeve is folded over the member for attachment of the carrier to the member, at least one carrier for an article for detachable connection to the member comprising a body and a sleeve having a first end attached to the body of the carrier and a second end with means for detachable attachment to the body of the carrier, the first end and the second end of the sleeve being spaced apart at their respective places of attachment to the body of the carrier so that the second end of the sleeve can be folded over the member and attached to the body of the carrier, and further comprising a tab made of stiff material having a first end attached to the carrier at or near the junction of the first end of the sleeve to the carrier and a second end remaining unattached, the tab having an axis generally aligned with the sleeve, the second end of the tab being capable of being inserted through the at least one loop when the sleeve is folded over the member for attachment of the carrier to the member and thereby fixing the carrier with respect to the member so that the carrier substantially may not be slid along the member whereas if the tab is not inserted into the at least one loop when the sleeve is folded over the member the carrier is not substantially fixed with respect to the member and may be slid along the member.

2. The carrier system according to claim 1 in which the member is a belt having two ends and further comprising a buckle for joining the two ends.

3. The carrier system according to claim 1 in which the tab is long enough that the second end of the tab is adjacent the means of attachment of the second end of the sleeve when the carrier for articles is connected to the member.

4. The carrier system according to claim 3 in which the second end of the tab is enclosed between the means of attachment of the second end of the sleeve and the body of the carrier when the carrier for articles is connected to the member.

5. A carrier for an article capable of detachable connection to an elongated planar member to be worn by an animate bearer such as a human being, the member having an outside surface facing away from the bearer's body and an inside surface facing toward the body of the bearer, and at least one loop attached to the outside surface of the member, the carrier comprising:

a body and a sleeve having a first end attached to the body of the carrier and second end with means for detachable attachment to the body of the carrier, the first end and the second end of the sleeve being spaced apart at their respective places of attachment to the body of the carrier so that the second end of the sleeve can be folded over the member and attached to the body of the carrier, and further comprising a tab made of stiff material having a first end attached to the carrier at or near the junction of the first end of the sleeve to the carrier and a second end remaining unattached, the tab having an axis generally aligned with the sleeve, wherein the second end of the tab is enclosed between the means of detachable attachment of the second end of the sleeve and the body of the carrier when the carrier for articles is connected to the member, the second end of the tab being capable of being inserted through the at least one loop attached to the outside surface of the member when the sleeve is folded over the member for attachment of the carrier to the member and thereby fixing the carrier with respect to the member so that the carrier substantially may not be slid along the member whereas if the tab is not inserted into the at least one loop when the sleeve is folded over the member the carrier is not substantially fixed with respect to the member and may be slid along the member.

6. The carrier system according to claim 5 wherein the tab is generally straight between the first end and the second end of the tab.

7. The carrier system according to claim 5 in which the tab is long enough that the second end of the tab is adjacent the means of attachment of the second end of the sleeve when the carrier for articles is connected to the member.

8. The carrier system according to claim 7 in which the second end of the tab is enclosed between the means of attachment of the second end of the sleeve and the body of the carrier when the carrier for articles is connected to the member.

9. A method for carrying articles with a carrying system, the carrier system comprising: an elongated planar member to be worn by an animate bearer, such as a human being, the member having an outside surface facing away from the bearer's body and an inside surface facing toward the body of the bearer, at least one loop attached to the outside surface of the member, wherein the loop comprises two ends and a middle section between the two ends, the ends of the loop are spaced apart along the planar member and attached to the outside surface of the planar member and the middle section is not attached to the outside surface of the planar member, whereby the tab may be received between the loop and the outside surface of the planar member when the sleeve is folded over the member for attachment of the carrier to the member, at least one carrier for an article for detachable connection to the member, the carrier comprising a body and a sleeve having a first end attached to the body of the carrier and a second end with means for detachable attachment to the body of the carrier, the first end and the second end of the sleeve being spaced apart at their respective places of attachment to the body of the carrier, a tab made of stiff material having a first end attached to the carrier at or near the junction of the first end of the sleeve to the carrier and a second end remaining unattached, the tab having an axis generally aligned with the sleeve, the method comprising the steps of:

folding the second end of the sleeve over the member, and attaching the second end of the sleeve to the body of the carrier.

10. The method according to claim 9 further comprising the step of:

before the sleeve is folded over the member and the second end is attached to the body of the carrier, inserting the second end of the tab through the at least one loop attached to the outside surface of the member, whereby the carrier is fixed with respect to the member so that the carrier substantially may not be slid along the member.

11. The method according to claim 10 further comprising the steps of:

detaching the second end of the sleeve from the body of the carrier, folding the second end of the sleeve away from the member, removing the second end of the tab from the one loop attached to the outside surface of the member, folding the second end of the sleeve back over the member, attaching the second end of the sleeve to the body of the carrier, whereby the tab is not inserted into the at least one loop when the sleeve is folded over the member and the carrier is not substantially fixed with respect to the member and may be slid along the member.

* * * * *

UNITED STATES PATENT AND TRADEMARK OFFICE

CERTIFICATE OF CORRECTION

PATENT NO. : 7,770,770 B2
APPLICATION NO. : 11/663202
DATED : August 10, 2010
INVENTOR(S) : Douglas H. Murdoch et al.

It is certified that error appears in the above-identified patent and that said Letters Patent is hereby corrected as shown below:

At column 5, lines 63-66: delete "whereby the tab may be received between the loop and the outside surface of the planar member when the sleeve is folded over the member for attachment of the carrier to the member,".
At column 6, line 12: delete "through" and insert --between-- in its place.
At column 6, line 13: after "at least one loop" insert --and the outside surface of the planar member--.
At column 7, lines 5-9: delete "The carrier system according to claim 7 in which the second end of the tab is enclosed between the means of attachment of the second end of the sleeve and the body of the carrier when the carrier for articles is connected to the member.".
At column 7, line 10: delete "9" and insert --8-- therefor.
At column 7, lines 21-24: delete "whereby the tab may be received between the loop and the outside surface of the planar member when the sleeve is folded over the member for attachment of the carrier to the member,".
At column 8, line 3: after "aligned with the sleeve" insert --whereby the tab may be received between the loop and the outside surface of the planar member when the sleeve is folded over the member for attachment of the carrier to the member,--.
At column 8, line 8: delete "10" and insert --9-- therefor; delete the original instance of "9" and insert --8-- therefor.
At column 8, line 16: delete "11" and insert --10-- therefor; delete the original instance of "10" and insert --9-- therefor.

Signed and Sealed this
Fifteenth Day of February, 2011

David J. Kappos

David J. Kappos
*Director of the United States Patent and Trademark Office*